US009827573B2

(12) United States Patent
Afanasiev et al.

(10) Patent No.: US 9,827,573 B2
(45) Date of Patent: Nov. 28, 2017

(54) ELECTROSTATIC PRECIPITATOR

(71) Applicant: University of Washington, Seattle, WA (US)

(72) Inventors: Andrei Afanasiev, Seattle, WA (US); Alexander V. Mamishev, Seattle, WA (US)

(73) Assignee: University of Washington, Seattle, WA (US)

( * ) Notice: Subject to any disclaimer, the term of this patent is extended or adjusted under 35 U.S.C. 154(b) by 88 days.

(21) Appl. No.: 14/851,492

(22) Filed: Sep. 11, 2015

(65) Prior Publication Data

US 2016/0074876 A1 Mar. 17, 2016

Related U.S. Application Data

(60) Provisional application No. 62/049,293, filed on Sep. 11, 2014.

(51) Int. Cl.

| | |
|---|---|
| ***B03C 3/45*** | (2006.01) |
| ***B03C 3/60*** | (2006.01) |
| ***B03C 3/47*** | (2006.01) |

(52) U.S. Cl.
CPC . *B03C 3/60* (2013.01); *B03C 3/47* (2013.01)

(58) Field of Classification Search
CPC combination set(s) only.
See application file for complete search history.

(56) References Cited

U.S. PATENT DOCUMENTS

| | | | |
|---|---|---|---|
| 3,887,809 | A | 6/1975 | Marx et al. |
| 3,891,846 | A | 6/1975 | Ito |
| 3,965,400 | A | 6/1976 | Tolliver |
| 3,978,379 | A | 8/1976 | DelVecchio |

(Continued)

FOREIGN PATENT DOCUMENTS

| | | | |
|---|---|---|---|
| AU | 2013262819 | | 1/2015 |
| CN | 2342893 | Y | 10/1999 |

(Continued)

OTHER PUBLICATIONS

Wen et. al., Novel Electrodes of an Electrostatic Precipitator for Air Filtration, online Nov. 21, 2014, Journal of Electrostatics at Science Digest, 73 (2015), pp. 117-124.*

(Continued)

*Primary Examiner* — Duane Smith
*Assistant Examiner* — Sonji Turner
(74) *Attorney, Agent, or Firm* — McDonnell Boehnen Hulbert & Berghoff LLP

(57) ABSTRACT

An electrostatic precipitator may have different collecting and repelling electrodes surfaces. For example, a collecting electrode may have an internal conductive portion. A non-conductive or less conductive open cell foam covering may be applied to the conductive core of the collecting electrode. The foam may have cell sizes that vary within the volume of the foam or along the length of the foam. Accordingly the cell size of the foam near the leading, with respect to the direction of airflow, portion of the collector may be larger than the cell size of the foam nearer the trailing end of the collector and/or the cell size of the foam near the exterior of the collector may be larger than the cell size of the foam nearer to the interior of the collector.

11 Claims, 7 Drawing Sheets

(56) References Cited

U.S. PATENT DOCUMENTS 3,985,524 A 10/1976 Masuda
4,077,785 A * 3/1978 Hartshorn ..... B03C 3/84 55/DIG. 38
4,408,865 A 10/1983 Camis et al.
4,689,056 A 8/1987 Noguchi et al.
4,828,586 A * 5/1989 Joannou ..... B03C 3/155 96/66
4,886,527 A * 12/1989 Fottinger ..... B01D 39/083 307/400
4,976,858 A * 12/1990 Kadoya ..... B01D 39/1623 210/496
4,983,193 A * 1/1991 Tani ..... B01D 46/10 55/487
5,055,115 A 10/1991 Yikai et al.
5,055,118 A 10/1991 Nagoshi et al.
5,522,909 A 6/1996 Haggard
5,582,632 A 12/1996 Nohr et al.
5,698,165 A 12/1997 Terada et al.
6,176,977 B1 1/2001 Taylor et al.
6,231,643 B1 5/2001 Pasic et al.
6,251,171 B1 6/2001 Marra et al.
6,294,004 B1 * 9/2001 Summers ..... B03C 3/025 55/493
6,572,685 B2 * 6/2003 Dunshee ..... B03C 3/155 55/487
6,773,488 B2 * 8/2004 Potter ..... B03C 3/60 55/DIG. 39
6,773,489 B2 8/2004 Dunn et al.
6,783,575 B2 8/2004 Pasic et al.
6,855,190 B1 2/2005 Nikkhah et al.
6,888,314 B2 5/2005 Krichtafovitch et al.
6,932,857 B1 8/2005 Krigmont
6,937,455 B2 8/2005 Krichtafovitch et al.
6,955,708 B1 * 10/2005 Julos ..... B03C 3/011 422/121
7,105,041 B2 9/2006 Dunn et al.
7,150,780 B2 12/2006 Krichtafovitch et al.
7,248,003 B2 7/2007 Krichtafovitch et al.
7,258,729 B1 8/2007 Barsimanto et al.
7,594,958 B2 9/2009 Krichtafovitch et al.
7,708,813 B2 * 5/2010 Wiser ..... B03C 3/30 96/17
8,080,094 B2 12/2011 Vanderginst et al.
8,252,095 B2 * 8/2012 Wiser ..... B03C 3/30 55/528
8,337,600 B2 * 12/2012 Paur ..... B03C 3/41 55/DIG. 38
8,470,084 B2 * 6/2013 Ji ..... B03C 3/08 313/355
8,721,775 B2 * 5/2014 Chesebrough ..... B03C 3/09 96/66
8,795,601 B2 * 8/2014 Wiser ..... A61L 9/205 422/186.3
2002/0185003 A1 * 12/2002 Potter ..... B03C 3/60 95/57
2003/0037676 A1 * 2/2003 Dunshee ..... B03C 3/155 96/59
2003/0217642 A1 11/2003 Pasic et al.
2003/0217643 A1 11/2003 Masek et al.
2005/0051028 A1 3/2005 Botvinnik
2006/0107834 A1 5/2006 Vandenbelt et al.
2006/0268490 A1 11/2006 Joannou et al.
2007/0199450 A1 * 8/2007 Wiser ..... B03C 3/64 96/69
2007/0256563 A1 11/2007 Volodina et al.
2008/0047434 A1 2/2008 Kobayashi et al.
2009/0241777 A1 * 10/2009 Kaukoniemi ..... B01D 46/0032 95/79
2010/0144913 A1 6/2010 Alteheld et al.
2011/0002814 A1 * 1/2011 Wiser ..... B03C 3/30 422/121
2011/0038771 A1 2/2011 Buelow et al.
2011/0174157 A1 * 7/2011 Ptak ..... B01D 46/0001 96/15
2011/0277637 A1 * 11/2011 Chesebrough ..... B03C 3/09 96/96
2013/0183201 A1 * 7/2013 Wiser ..... A61L 9/205 422/121
2014/0338536 A1 * 11/2014 Wiser ..... A61L 9/205 96/80
2015/0224738 A1 8/2015 Gallagher
2015/0375237 A1 * 12/2015 Kojima ..... B03C 3/41 95/57
2017/0021363 A1 1/2017 Krichtafovitch

FOREIGN PATENT DOCUMENTS

CN 101862704 A 10/2010
CN 102000632 A 4/2011
DE 2854742 A1 7/1980
DE 8810485 U1 12/1988
DE 3802748 A1 * 8/1989 ..... B03C 3/017
DE 19859827 A1 6/2000
EP 2849888 A1 3/2015
GB 1559629 A 1/1980
JP S53-10484 U 1/1978
JP S54-39612 A 3/1979
JP S59-150539 A 8/1984
JP S61-218644 A 9/1986
JP 2000-005633 A 1/2000
JP 2002-143719 A 5/2002
JP 2008-539064 A 11/2008
WO WO 02100551 A1 * 12/2002 ..... B03C 3/60
WO WO 2013173528 A1 * 11/2013 ..... B03C 3/08

OTHER PUBLICATIONS

Krichtafovitch et. al., Design of an Electronic Air Cleaner with Porous Collecting Electrodes, 2013, Proceedings of the 2013 EAS Annual Meeting on Electrostatics (2013) C5-1-8, pp. 1-8.*
Adamiak, et al., "Simulation of corona discharge in point-plane configuration," Journal of Electrostatics, vol. 61, No. 2, pp. 85-98, 2004.
CN 201380037669.1, 1st Office Action dated Mar. 10, 2016, 41 pages.
English translation of 2nd CN Office Action, 9 pages, dated Sep. 27, 2016.
JP 2015-512816, 1st JP Office Action, 8 pages, dated Oct. 4, 2016.
Komeili, et al., "Flow characteristics of wire-rod type electrohydrodynamic gas pump under negative corona operations," Journal of Electrostatics, vol. 66, No. 5-6, pp. 342-353, 2008.
PCT/US2013/041259, (May 15, 2013), International Search Report and Written Opinion, 14 pages dated Sep. 5, 2013.
Quast, et al., "Measuring and Calculation of Positive Corona Currents Using Comsol Multiphysics," Proceedings of the COMSOL Conference, 7 pages, 2009.

* cited by examiner

ELECTROSTATIC PRECIPITATOR

CROSS-REFERENCE TO RELATED APPLICATIONS

This application claims the benefit of U.S. Provisional Application 62/049,293 filed Sep. 11, 2014 ("Nonhomogeneous, open-cell foam coating for electrostatic air cleaner collector plates"), the disclosure of which is expressly incorporated herein by reference in its entirety.

BACKGROUND OF THE INVENTION

1. Field of the Invention

The present technology relates generally to an electrostatic precipitator for cleaning gas flows. In particular, several embodiments are directed toward ELECTROSTATIC PRECIPITATORs having collection structures with open cells of varying sizes. Similar embodiments may also be useful for cleaning other types of gases industrial electrostatic precipitators, or other forms of electrostatic filtration.

2. Description of the Related Technology

The most common types of residential or commercial HVAC filters employ a fibrous filter media (made from polyester fibers, glass fibers or microfibers, etc.) placed substantially perpendicular to the airflow through which air may pass (e.g., an air conditioner filter, a HEPA filter, etc.) such that particles are removed from the air mechanically (coming into contact with one or more fibers and either adhering to or being blocked by the fibers); some of these filters are also electrostatically charged (either passively during use, or actively during manufacture) to increase the chances of particles coming into contact and staying adhered to the fibers.

Fibrous media filters typically have to be cleaned and/or replaced regularly due to an accumulation of particles. Furthermore, fibrous media filters are placed substantially perpendicular to the airflow, increasing airflow resistance and causing a significant static pressure differential across the filter, which increases as more particles accumulate or collect in the filter. Pressure drop across various components of an HVAC system is a constant concern for designers and operators of mechanical air systems, since it either slows the airflow or increases the amount of energy required to move the air through the system. Accordingly, there exists a need for an air filter capable of relatively long intervals between cleaning and/or replacement and a relatively low pressure drop across the filter after installation in an HVAC system.

Another form of air filter is known as an electrostatic precipitator. A conventional electrostatic precipitator includes one or more corona electrodes and one or more smooth metal electrode plates that are substantially parallel to the airflow. The corona electrodes produce a corona discharge that ionizes air molecules in an airflow received into the filter. The ionized air molecules impart a net charge to nearby particles (e.g., dust, dirt, contaminants etc.) in the airflow. The charged particles are subsequently electrostatically attracted to one of the electrode plates and thereby removed from the airflow as the air moves past the electrode plates. After a sufficient amount of air passes through the filter, the electrodes can accumulate a layer of particles and dust and eventually need to be cleaned. Cleaning intervals may vary from, for example, thirty minutes to several days. Further, since the particles are on an outer surface of the electrodes, they may become re-entrained in the airflow since a force of the airflow may exceed the electric force attracting the charged particles to the electrodes, especially if many particles agglomerate through attraction to each other, thereby reducing the net attraction to the collector plate. Such agglomeration and re-entrainment may require use of a media filter that is placed substantially perpendicular to the airflow, thereby increasing airflow resistance.

U.S. patent application Ser. No. 14/401,082 filed on 15 May 2013 and published 21 Nov. 2013 as US 2015/0323217 A1, the disclosure of which is expressly incorporated by reference herein shows an electrostatic precipitator with improved performance. An article by Wen, T.; Wang, H.; Krichtafovitch, I.; and Mamishev, A. entitled *Novel Electrodes of an Electrostatic Precipitator for Air Filtration*, submitted to the Journal of Electrostatics, Nov. 12, 2014, the disclosure of which is expressly incorporated herein by reference, presents working principles of electrostatic precipitators and provides a discussion on the design concepts and schematics of a foam-covered electrostatic precipitator. The collector electrodes in the electrostatic precipitator described therein may be covered with porous foam. Electrostatic precipitators with foam-covered electrodes have improved capacity for particle collection, due in part, to the increased surface area of foam over metal collector plates and improved filtration efficiency because the effect of particle re-entrainment is reduced. Nevertheless, foam-covered electrostatic precipitators described in U.S. application Ser. No. 14/401,082 would have even better performance in some environments, particularly very dusty areas, if the collection capacity were increased thereby reducing the frequency of foam collector cleaning or replacement.

SUMMARY OF THE INVENTION

It is an object of the invention to have an electrostatic precipitator suitable for very dusty areas.

It is an object to improve particle capture and retention, especially while filtering wide range of the particles: from micron size to sub-micron and ultra-fine (e.g.,) nanometer size particles.

It is an object to have collector structures capable of higher capacity particle collection useful for cleaning gas flows for use in heating, air-conditioning, and ventilation (HVAC) systems and other types of gas industrial electrostatic precipitators, or other forms of electrostatic filtration.

According to the invention an electrostatic precipitator may have an electrode assembly that includes one or more first electrodes and one or more second electrodes. The first electrodes may include an internal first conductive portion and an outer surface generally parallel with the air flow direction through the cavity. The first electrodes may have a first portion including a porous open-cell material that is generally parallel to with the air flow direction. The porous material may be engineered in a way that cells size varies through the length (i.e.: dimension) of the first electrode. The porous material may have greater cell size upwind and smaller cell size downwind of the air flow or greater cell size closer to internal first conductive portion the smaller cell size outward of the internal first conductive portion. The porous material may have a greater cell size downwind and smaller cell size upwind of the air flow. The porous material have a smaller cell size closer to internal first conductive portion and a greater cell size outward of the internal first conductive portion.

The invention may also be configured as a collector for use in an electrostatic precipitator having a porous material with an open cell structure mounted on a conductive core. A second porous material having an open cell structure mounted may be mounted on a conductive core. The first porous material may have a dominant cell size that is different than a dominant cell size of said second porous material. The first porous material and the second porous material may both mounted on a single conductive core, or on different conductive cores. The porous material may be orientated generally parallel with the air flow and thickness generally orthogonal to the air flow. The porous material may be engineered such that cell size varies through the length of the first electrode. The porous material may have a greater cell size upwind and smaller cell size downwind of the air flow. The porous material may have a greater cell size closer to the internal first conductive portion the smaller cell size outward of the internal first conductive portion. The porous material may have greater cell size downwind and smaller cell size upwind of the air flow. The porous material may have smaller cell size closer to internal first conductive portion the greater cell size outward of the internal first conductive portion. The porous material may have an open cell structure mounted on a conductive core, a second porous material having an open cell structure mounted on a conductive core where the first porous material has a dominant (i.e., predominant) cell size that is different than the dominant cell size of the second porous material. The first porous material and said second porous material may both be mounted on a single conductive core.

Various objects, features, aspects, and advantages of the present invention will become more apparent from the following detailed description of preferred embodiments of the invention, along with the accompanying drawings in which like numerals represent like components.

Moreover, the above objects and advantages of the invention are illustrative, and not exhaustive, of those that can be achieved by the invention. Thus, these and other objects and advantages of the invention will be apparent from the description herein, both as embodied herein and as modified in view of any variations which will be apparent to those skilled in the art.

DETAILED DESCRIPTION OF A PREFERRED EMBODIMENT

Figure 1A:
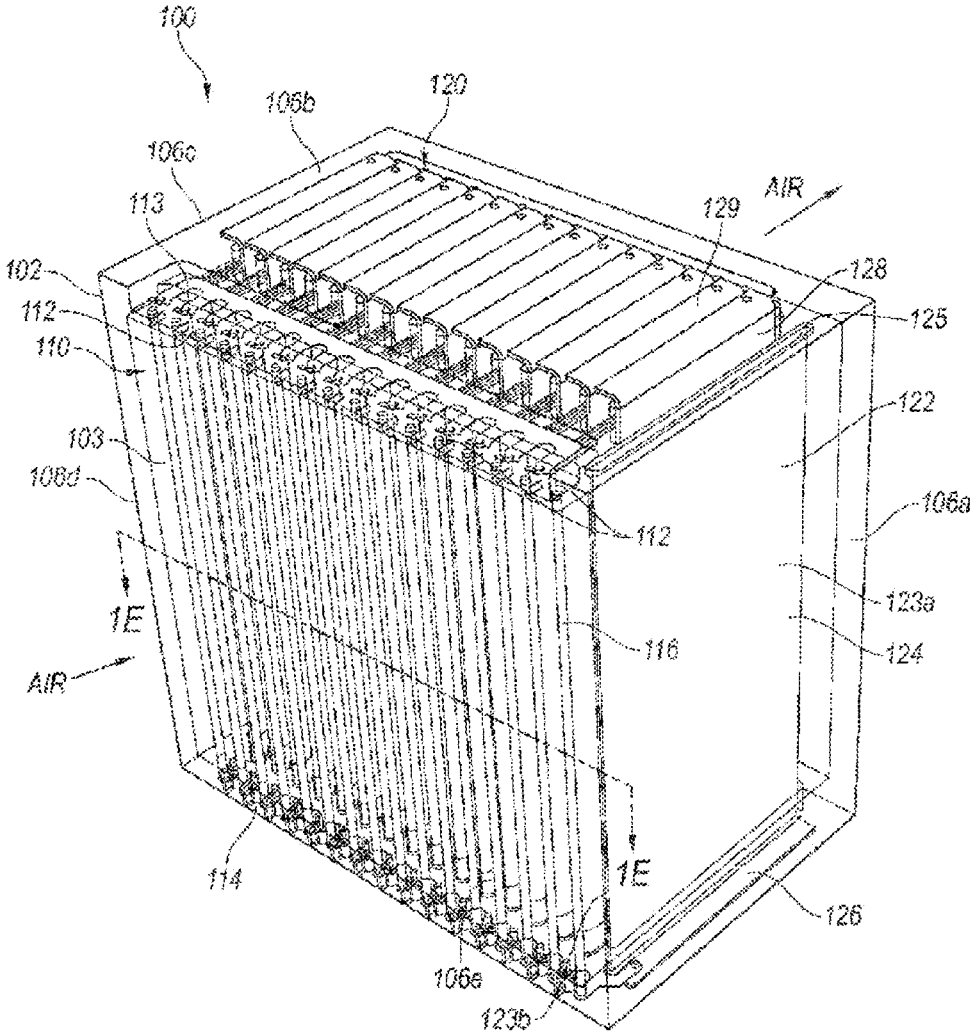
FIG. 1A is a rear isometric view of an electronic air cleaner (EAC) configured in accordance with embodiments of the present technology.

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein may also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

The present technology relates generally to cleaning gas flows using electrostatic precipitators and associated systems and methods. In one aspect of the present technology, an electrostatic precipitator may include a housing having an inlet, an outlet, and a cavity there between. An electrode assembly may be positioned in the air filter between the inlet and the outlet. The electrode assembly may include a plurality of first electrodes (e.g., electrodes) and a plurality of second electrodes (e.g., repelling electrodes), both configured substantially parallel to the airflow.

The present technology relates generally to cleaning gas flows using electrostatic filters and associated systems and methods. An electronic air cleaner (EAC) may include a housing having an inlet, an outlet, and a cavity therebetween. An electrode assembly positioned in the air filter between the inlet and the outlet can include a plurality of first electrodes (e.g., collecting electrodes) and a plurality of second electrodes (e.g., repelling electrodes), both configured substantially parallel to the airflow. The first electrodes can include a first collecting portion made of a material having a porous, electrically conductive, open-cell structure (e.g., melamine foam). In some embodiments, the first and second electrodes may be arranged in alternating columns within the electrode assembly. The first electrodes can be configured to operate at a first electrical potential and the second electrodes can be configured to operate at a second electrical potential different from the first electrical potential. Moreover, in some embodiments, the EAC may also include a corona electrode disposed in the cavity at least proximate the inlet.

A method of filtering air may include creating an electric field using a plurality of corona electrodes arranged in an airflow path, such that the corona electrodes are positioned to ionize at least a portion of air molecules from the airflow. The method may also include applying a first electric potential at a plurality of first electrodes spaced apart from the corona electrodes, and receiving, at the first collection portion, particulate matter electrically coupled to the ionized air molecules. Each of the first electrodes may include a corresponding first collection portion comprising an open-cell, electrically conductive, porous media.

An EAC having a housing with an inlet, an outlet and a cavity may include an ionizing stage and a collecting stage disposed in the cavity. The ionizing stage may be configured, for example, to ionize molecules in air entering the cavity through the inlet and charge particulates in the air. The collecting stage may include, for example, one or more collecting electrodes with an outer surface generally parallel with an airflow through the cavity and a first collecting portion made of a first material having an open-cell structure. The EAC may also include repelling electrodes in the collecting stage. The first material may comprise an open-cell, porous media, such as, for example, melamine foam. The first material may also comprise a disinfecting material and/or a pollution-reducing material.

Figure 1B:
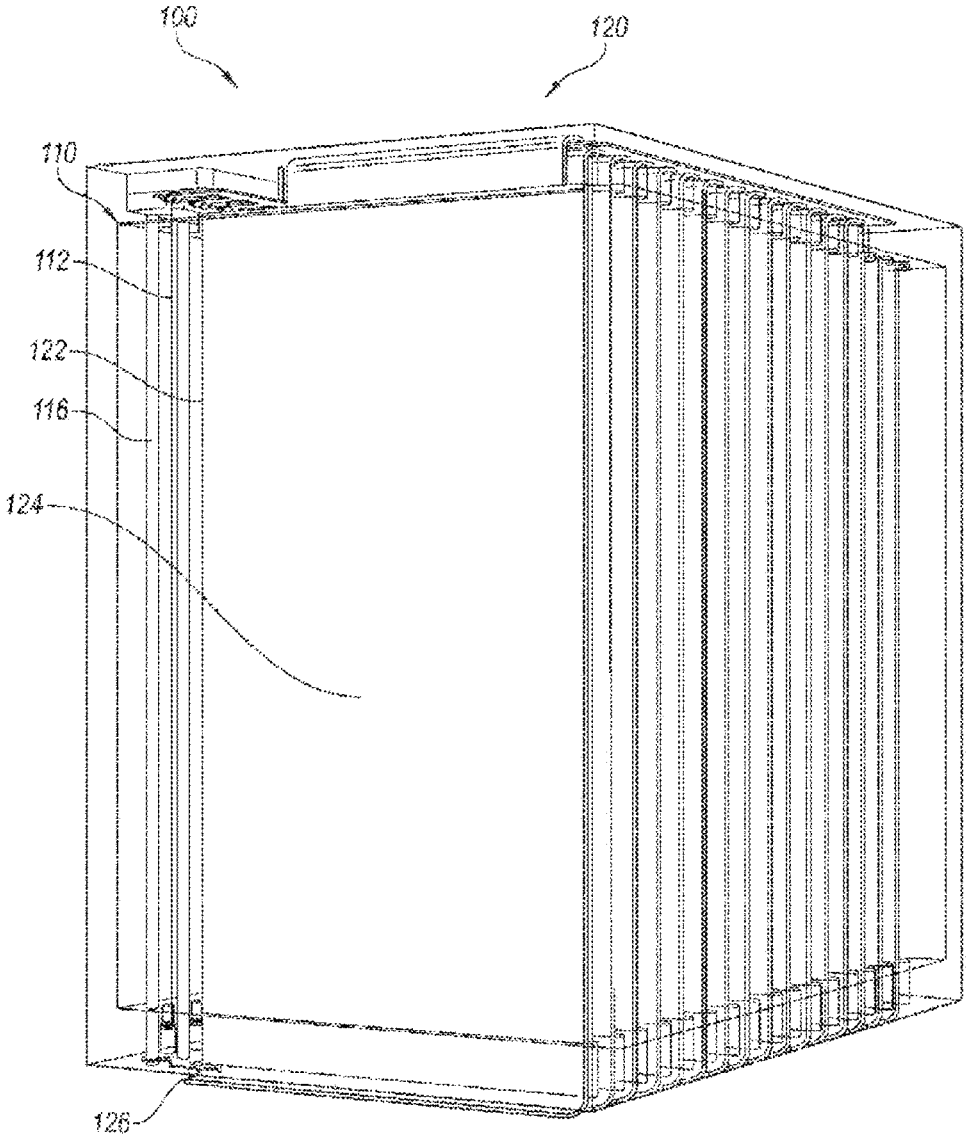
FIG. 1B is a side isometric view of the EAC of FIG. 1A.
Figure 1C:
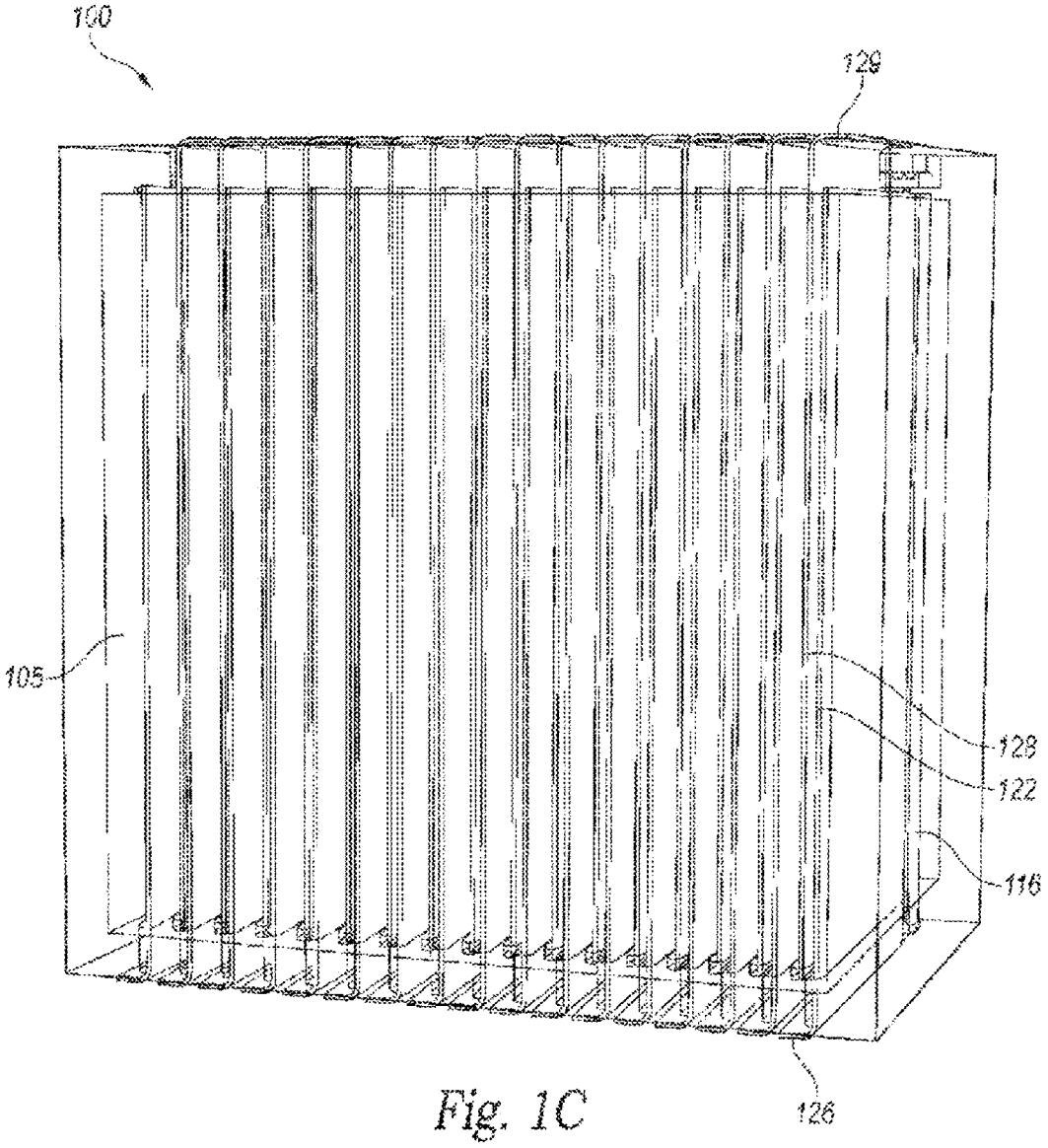
FIG. 1C is a front isometric view of the EAC of FIG. 1A.
Figure 1D:
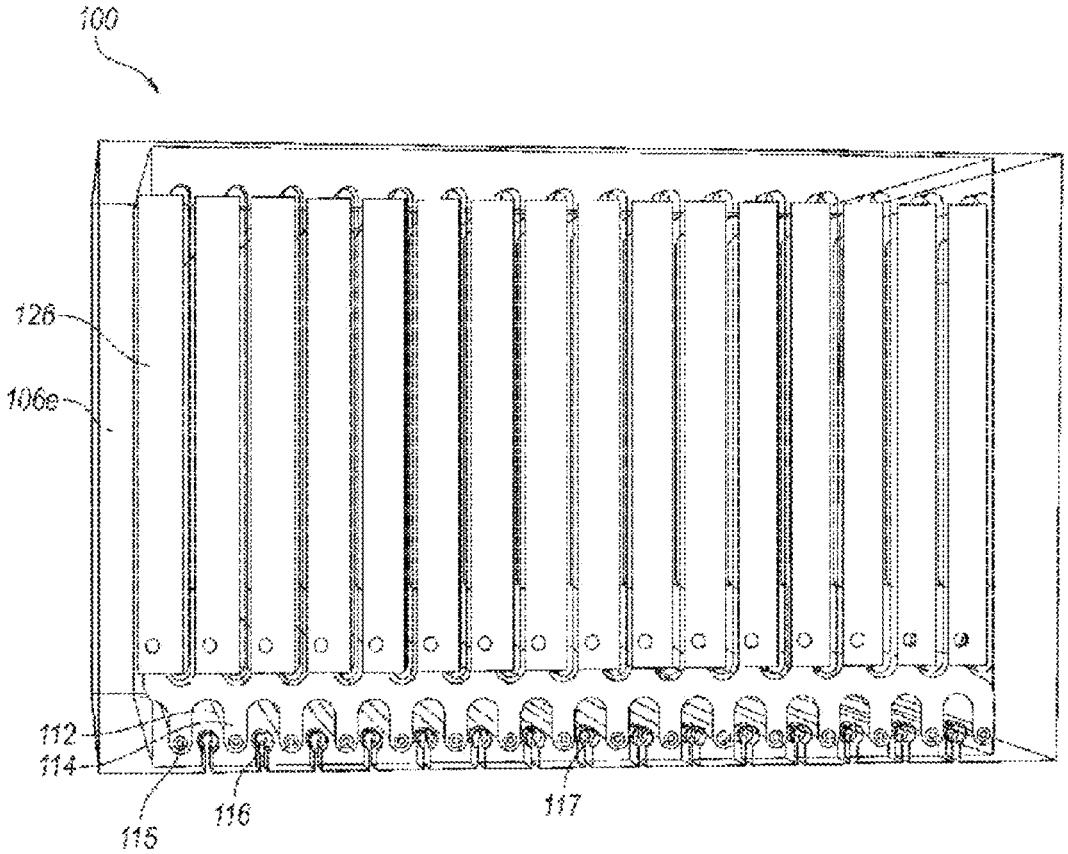
FIG. 1D is an underside view of the EAC of FIG. 1A.
Figure 1E:
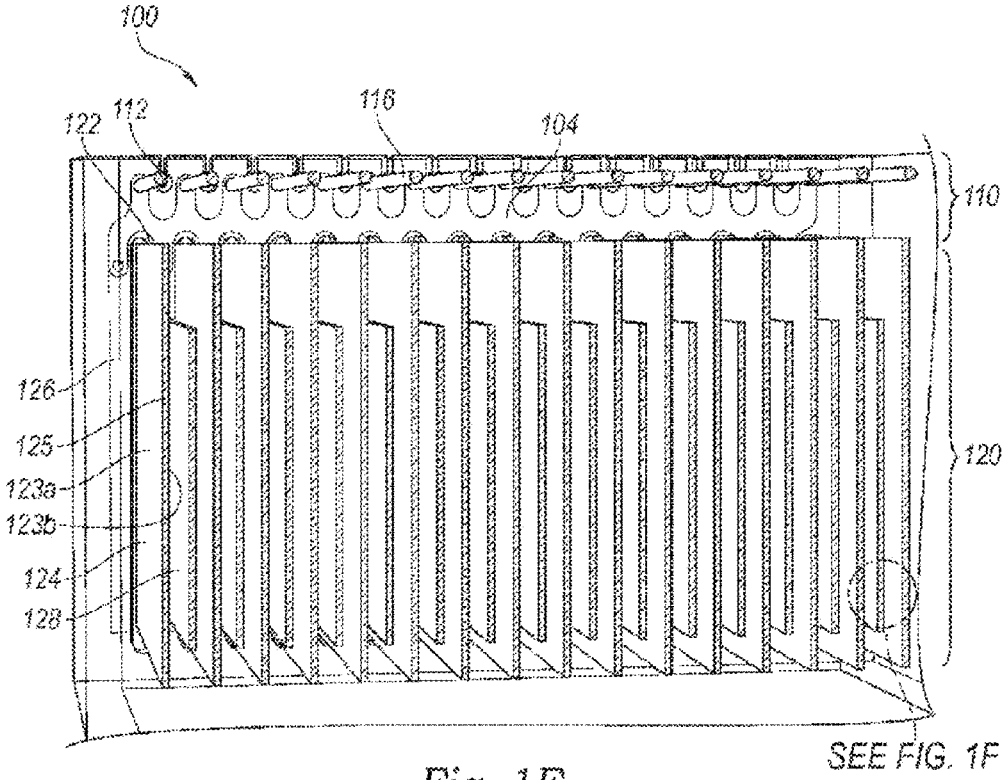
FIG. 1E is a top cross sectional view of FIG. 1A along a line 1E.
Figure 1F:
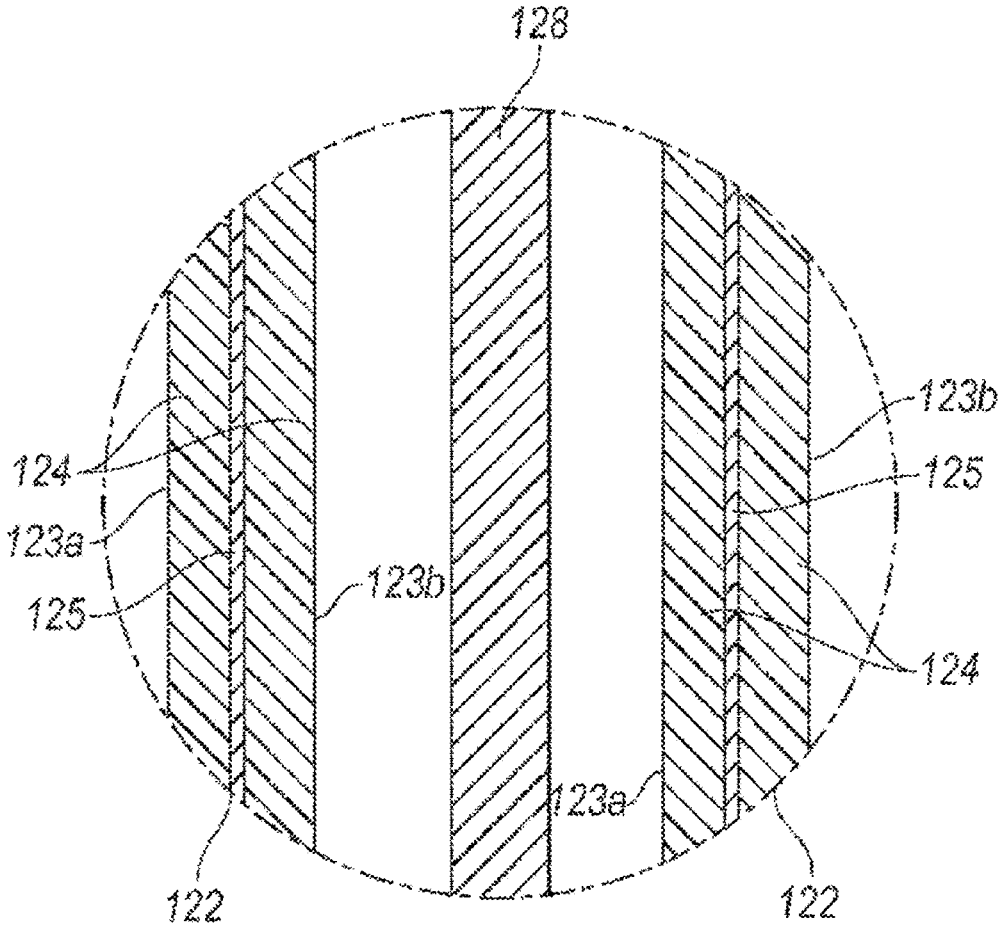
FIG. 1F is an enlarged view of a portion of FIG. 1E.

FIG. 1A is a rear isometric view of an electronic air cleaner 100. FIGS. 1B, 1C and 1D are front side isometric, front isometric and underside views, respectively, of the air cleaner 100. FIG. 1E is a top cross sectional view of the air cleaner 100 along the line 1E shown in FIG. 1A. FIG. 1F is an enlarged view of a portion of FIG. 1E. Referring to FIGS. 1A through 1F together, the air cleaner 100 includes a corona electrode assembly or ionizing stage 110 and a collection electrode assembly or collecting stage 120 disposed in a housing 102. The housing 102 includes an inlet 103, an outlet 105 and a cavity 104 between the inlet and the outlet. The housing 102 includes a first side surface 106*a*, an upper surface 106*b*, a second side surface 106*c*, a rear surface portion 106*d*, an underside surface 106*e*, and a front surface portion 106*f* (FIG. 1C). Portions of the surfaces 106*a-f* are hidden for clarity in FIGS. 1A through 1F. In the illustrated embodiment, the housing 102 has a generally rectangular solid shape. In other embodiments, however, the housing 102 can be built or otherwise formed into any suitable shape (e.g., a cube, a hexagonal prism, a cylinder, etc.).

The ionizing stage 110 is disposed within the housing 102 at least proximate the inlet 103 and comprises a plurality of corona electrodes 112 (e.g., electrically conductive wires, rods, plates, etc.). The corona electrodes 112 are arranged within the ionizing stage between a first terminal 113 and a second terminal 114. A plurality of individual apertures or slots 115 can receive and electrically couple the individual corona electrodes 112 to the second terminal 114. A plurality of exciting electrodes 116 are positioned between the corona electrodes 112 and the inlet 103. The first terminal 113 and the second terminal 114 can be electrically connected to a power source (e.g., a high voltage electrical power source) to produce an electrical field having a relatively high electrical potential difference (e.g., 5 kV, 10 kV, 20 kV, etc.) between the corona electrodes 112 and the exciting electrodes 116. In one embodiment, for example, the corona electrodes 112 can be configured to operate at +5 kV while the exciting electrodes 116 can be configured operate at ground. In other embodiments, however, both the corona electrodes 112 and the exciting electrodes 116 can be configured to operate at any number of suitable electrical potentials. Moreover, while the ionizing stage 110 in the illustrated embodiment includes the corona electrodes 112, in other embodiments the ionizing stage 110 may include any suitable means of ionizing molecules (e.g., a laser, an electrospray ionizer, a thermospray ionizer, a sonic spray ionizer, a chemical ionizer, a quantum ionizer, etc.). Furthermore, in the illustrated embodiment of FIGS. 1A-1F, the exciting electrodes 116 have a first diameter greater than (e.g., approximately twenty times larger) a second diameter of the corona electrodes 112. In other embodiments, however, the first diameter and second diameter can be any suitable size.

The collecting stage 120 is disposed in the cavity between the ionizing stage 110 and the outlet 105. The collecting stage 120 includes a plurality of collecting electrodes 122 and a plurality of repelling electrodes 128. In the illustrated embodiments of FIGS. 1A-1F, the collecting electrodes 122 and the repelling electrodes 128 are arranged in alternating rows within the collecting stage 120. In other embodiments, however, the collecting electrodes 122 and the repelling electrodes 128 may be positioned within the collecting stage 120 in any suitable arrangement.

Each of the collecting electrodes 122 includes a first collecting portion 124 having a first outer surface 123*a* opposing a second outer surface 123*b*, and an internal conductive portion 125 disposed therebetween. At least one of the first outer surface 123 a and the second outer surface 123*b* may be arranged to be generally parallel with a flow of a gas (e.g., air) entering the cavity 104 via the inlet 103. The first collecting portion 124 can be configured to receive and collect and receive particulate matter (e.g., particles having a first dimension between 0.1 microns and 1 mm, between 0.3 microns and 10 microns, between 0.3 microns and 25 microns and/or between 100 microns and 1 mm), and may comprise, for example, an open-cell porous material or medium such as, for example, a melamine foam (e.g., formaldehyde-melamine-sodium bisulfate copolymer), a melamine resin, activated carbon, a reticulated foam, a nanoporous material, a thermoset polymer, a polyurethanes, a polyethylene, etc. The use of an open-cell porous material can lead to a substantial increase (e.g., a tenfold increase, a thousandfold increase, etc.) in the effective surface area of the collecting electrodes 122 compared to, for example, a smooth metal electrode that may be found in conventional electronic air cleaners. Moreover, the open-cell porous material can receive and collect particulate matter (dust, dirt, contaminants, etc.) within the material, thereby reducing accumulation of particulate matter on the outer surfaces 123*a* and 123*b*, as well as limiting the maximum size of agglomerates that may form from the collected particulates based on the size of a first dimension of the cells in the porous material (e.g., from about 1 micron to about 1000 microns, from about 200 microns to about 500 microns, from about 140 microns to about 180 microns, etc.) In some embodiments, the open-cell porous material can be made of a non-flammable material to reduce the risk of fire from, for example, a spark (e.g., a corona discharge from one of the corona electrodes 112). In some embodiments, the open-cell porous material may also be made from a material having a high-resistivity (e.g., greater than or equal to $1\times10^7$ Ω-m, $1\times10^9$ Ω-m, $1\times10^{11}$ Ω-m, etc.) Using a high resistivity material (e.g., greater than $10^2$ Ohm-m, between $10^2$ and $10^9$ Ohm-m, etc.) in the first collecting portion 124 can reduce, for example, a likelihood of a corona discharge between the corona electrodes and the collecting electrodes 122 or a spark over between the collecting electrode 122 and the repelling electrode 128. In some embodiments, the first collecting portion 124 may also include a disinfecting material (e.g., $TIO_2$) and/or a material (e.g., MnO2, a thermal oxidizer, a catalytic oxidizer, etc.) selected to reduce and/or neutralize volatile organic compounds (e.g., ozone, formaldehyde, paint fumes, CFCs, benzene, methylene chloride, etc.). In other embodiments, the first collecting portion 124 may include one or more nanoporous membranes and/or materials (e.g., manganese oxide, nanoporous gold, nanoporous silver, nanotubes, nanoporous silicon, nanoporous polycarbonate, zeolites, silica aerogels, activated carbon, graphene, etc.) having pore sizes ranging from, for example, 0.1 nm-1000 nm. In some further embodiments, the first collecting portion 124 (comprising, e.g., one or more of the nanoporous materials above) may be configured to detect a composition of the particulate matter accumulated within the collecting electrodes 122. In these embodiments, a voltage can be applied across the first collecting portion 124 and various types of particulate matter may be detected by monitoring, for example, changes in an ionic current passing therethrough. If a particle of interest (e.g., a toxin, a harmful pathogen, etc.) is detected, then an operator of a facility control system (not shown) coupled to the air cleaner 100 can be alerted.

In some embodiments, the first collecting portion 124 may be made of a substantially rigid material. In certain of these embodiments, elastic or other tension-based mounting members are not necessary for securing the first collection portion 1224 within the cavity. For example, the rigidity of the material in these embodiments may be sufficient to substantially support itself in a vertical direction within the cavity. In certain of these embodiments, an internal conductive portion 125 is not included in the collecting electrodes 122, wherein material itself is sufficiently conductive to carry the requisite charge. In such embodiments, the material may include one or more of the conductive materials or compositions listed above.

Referring to FIG. 1F, the internal conductive portion 125 can include a conductive surface or plate (e.g., a metal plate) sandwiched between opposing layers of the first collecting portion 124 and adhered thereto via an adhesive (e.g., cyanoacrylate, an epoxy, and/or another suitable bonding agent). In other embodiments, however, the internal conductive portion 125 can comprise any suitable conductive material or structure such as, for example, a metal plate, a metal grid, a conductive film (e.g., a metalized Mylar film), a conductive epoxy, conductive ink, and/or a plurality of conductive particles (e.g., a carbon powder, nanoparticles, etc.) distributed throughout the collecting electrodes 122. A coupling structure or terminal 126 can couple the internal conductive portion 125 of each of the collecting electrodes 122 to an electrical power source (not shown). Similarly, a coupling structure or terminal 129 can couple each of the repelling electrodes 128 to an electrical power source (not shown). The collecting electrodes 122 may be configured to operate, for example, at a first electrical potential different from a second electrical potential of the repelling electrodes 128 when connected to the electrical power source. Furthermore, within individual collecting electrodes 122, the internal conductive portion 125 can be configured operate at a greater electrical potential than either the first outer surface 123*a* or the second outer surface 123*b* of the individual collecting electrodes. In some embodiments, for example, the internal conductive portion 125 may be configured to have a first electrical conductivity greater than a second electrical conductivity of first collecting portion 124. Accordingly, the first outer surface 123*a* and/or the second outer surface 123*b* may have a first electrical potential less than a second electrical potential at the internal conductive portion 125. A difference between the first and second electrical potentials, for example, can attract charged particles into the first collecting portion 124 toward the internal conductive portion 125. In some embodiments, for example, the outer surfaces 123*a* and 123*b* have a second electrical conductivity lower than the first electrical conductivity.

In operation, the air cleaner 100 can receive electric power from a power source (not shown) coupled to the corona electrodes 112, the exciting electrodes 116, the collecting electrodes 122, and the repelling electrodes 128. The individual corona electrodes 112 can receive, for example, a high voltage (e.g., 10 kV, 20 kV, etc.) and emit ions resulting in an electric current proximate the individual corona electrodes 112 and flowing toward the exciting electrodes 116 or/and the collecting electrodes 122. The corona discharges can ionize gas molecules (e.g., air molecules) in the incoming gas (e.g., air) entering the housing 102 and the cavity 104 through the inlet 103. As the ionized gas molecules collide with and charge incoming particulate matter that flows from the ionizing stage 110 toward the collecting stage 120, particulate matter (e.g., dust, ash, pathogens, spores, etc.) in the gas can be electrically attracted to and, thus, electrically coupled to the collecting electrodes 122. The repelling electrodes 128 can repel or otherwise direct the charged particulate matter toward adjacent collecting electrodes 122 due to a difference in electrical potential and/or a difference in electrical charge between the repelling electrodes 128 and the collecting electrodes 122. As described in further detail below with reference to FIGS. 2B and 2C, the repelling electrodes 128 may also include a means for aerodynamically directing charged particulate matter toward adjacent collecting electrodes 122.

The corona electrodes 112, the collecting electrodes 122, and the repelling electrodes 128 can be configured to operate at any suitable electrical potential or voltage relative to each other. In some embodiments, for example, the corona electrodes 112, the collecting electrodes 122, and the repelling electrodes 128 can all have a first electrical charge, but may also be configured to have first, second, third, and fourth voltages, respectively. A difference between the first, second, third and fourth voltage can determine a path that one or more charged particles (e.g., charged particulate matter) through the ionizing stage 110. For instance, the collecting electrodes 122 and the exciting electrodes 116 may be grounded, while the corona electrodes may have an electrical potential between, for example, 4 kV and 10 kV and the repelling electrodes 128 may have an electrical potential between, for example, 6 kV and 20 kV. Moreover, portions of the collecting electrodes 122 may have different electrical potentials relative to other portions. For example, in one or more individual collecting electrodes 122, the internal conductive portion 125 may have a different electrical potential (e.g., a higher electrical potential) than the corresponding first outer surface 123*a* or second outer surface 123*b*, thereby creating an electric field within the collecting portion 124.

As those of ordinary skill in the art will appreciate, the electrical potential difference between the internal conductive portion 125 and the corresponding first outer surface 123*a* and/or second outer surface 123*b* may be caused by a portion of an ionic current flowing from an adjacent repelling electrode 128. When this ionic current Ii flows through the porous material (e.g., the collecting portion 124) that has a relatively high electrical resistance $R_{por}$ (e.g., between 20 Megaohms and 2 Gigaohms) it creates certain potential difference $V_{d_f}$ described by Ohm's law: $V_{d_f}=Ii\times R_{por}$. This potential difference creates the electric field E in the body of the porous material. A charged particle (e.g., particulate matter) in this electric field E is subject to the Coulombic force F of the field E described by:

$F=q*E$, where q is the particle electrical charge.

Under this force F, a charged particle may penetrate deep into the porous material (e.g., the collecting portion 124)

where it remains. Accordingly, charged particulate matter may not only be directed and/or repelled toward the internal conductive portion 125 of the collecting electrodes 122, but may also be received, collected, and/or absorbed into the first collecting portion 124 of the individual collecting electrodes 122. As a result, particulate matter does not merely accumulate and/or adhere to the outer surfaces 123*a* and 123*b*, but is instead received and collected into the first collecting portion 124.

In some embodiments, for example, the porous material resistivity has a specific resistivity that allows the ionic current flow to the internal conductive portion 125 (i.e., should be slightly electrically conductive). In these embodiments, for example, the porous material can have a resistance on the order of Megaohms to prevent spark discharge between the collecting and the repelling electrodes.

In other embodiments, the strength of the electric field E can be adjustable in response to the relative size of the cells in the porous material (e.g., the collection portion 124). As those of ordinary skill in the art will appreciate, the electric field E needed to absorb particles into the collection portion 124 may be proportional to the cell size. For example, the strength of the electric field E can have a first value when the cells of the collection portion 124 have a first size (e.g., a diameter of approximately 150 microns). The strength of the electric field E can have a second value (e.g., a value greater than the first value) when the cells of the collecting portion 124 have a second size (e.g., a diameter of approximately 400 microns) to retain larger size particles accumulated therein.

As discussed above, the internal conductive portion 125 of the collecting electrodes 122 can be configured operate at an electrical potential different from either the first outer surface 123*a* or the second outer surface 123*b* of the individual collecting electrodes 122. Accordingly, charged particulate matter may not only be directed and/or repelled toward the internal conductive portion 125 of the collecting electrodes 122, but may also be received, collected, and/or absorbed into the first collecting portion 124 of the individual collecting electrodes 122. As a result, particulate matter does not merely accumulate and/or adhere to the outer surfaces 123*a* and 123*b*, but is instead received and collected into the first collecting portion 124. As explained above, the use of an open cell porous material in the first collecting portion 124 can provide a significant increase (e.g., 1000 times greater) in a collection surface area of the individual collecting electrodes 122 compared to embodiments without an open-cell porous media (e.g., collecting electrodes comprising metal plates). Moreover, because the collecting electrodes 122 are arranged generally parallel to the gas flow entering the housing 102, particulate matter in the gas can be removed with minimal pressure drop across the air cleaner 100 compared to conventional filters having fibrous media through which airflow is directed (e.g., HEPA filters).

After a period of use of the air cleaner 100, particulate matter can saturate the first collecting portion 124 of the individual collection electrodes. In some embodiments, the collecting electrodes 122 can be configured to be removable (and/or disposable) and replaced with different collecting electrodes 122. In other embodiments, the collecting electrodes 122 can be configured such that the used or saturated first collecting portion 124 can be removed from the internal conductive portion 125 and discarded, to be replaced by a new clean collecting portion 124, thereby refurbishing the collecting electrodes 122 for continued used without discarding the internal conductive portion 125. One feature of the present technology is that replacing or refurbishing the collecting electrodes 122 is expected to be more cost effective than replacing electrodes made entirely or substantially of metal. Moreover, the replaceability and disposability of the collecting electrodes 122, or the first collecting portion 124 thereof, facilitates removal of collected pathogens and contaminants from the system itself, and is expected to minimize the need for frequent cleaning. Furthermore, the present technology allows the filtering and/or cleaning of small particles in commercial HVAC systems without the need for adding a conductive fluid to the collecting electrodes 122.

In another aspect of the present technology, a method of filtering air may include creating an electric field using a plurality of corona electrodes arranged in an airflow path, such that the corona electrodes are positioned to ionize a portion of air molecules from the airflow. The method may also include applying a first electric potential at a plurality of first electrodes spaced apart from the corona electrodes, and receiving, at the first collection portion, particulate matter electrically coupled to the ionized air molecules.

Figure 2:
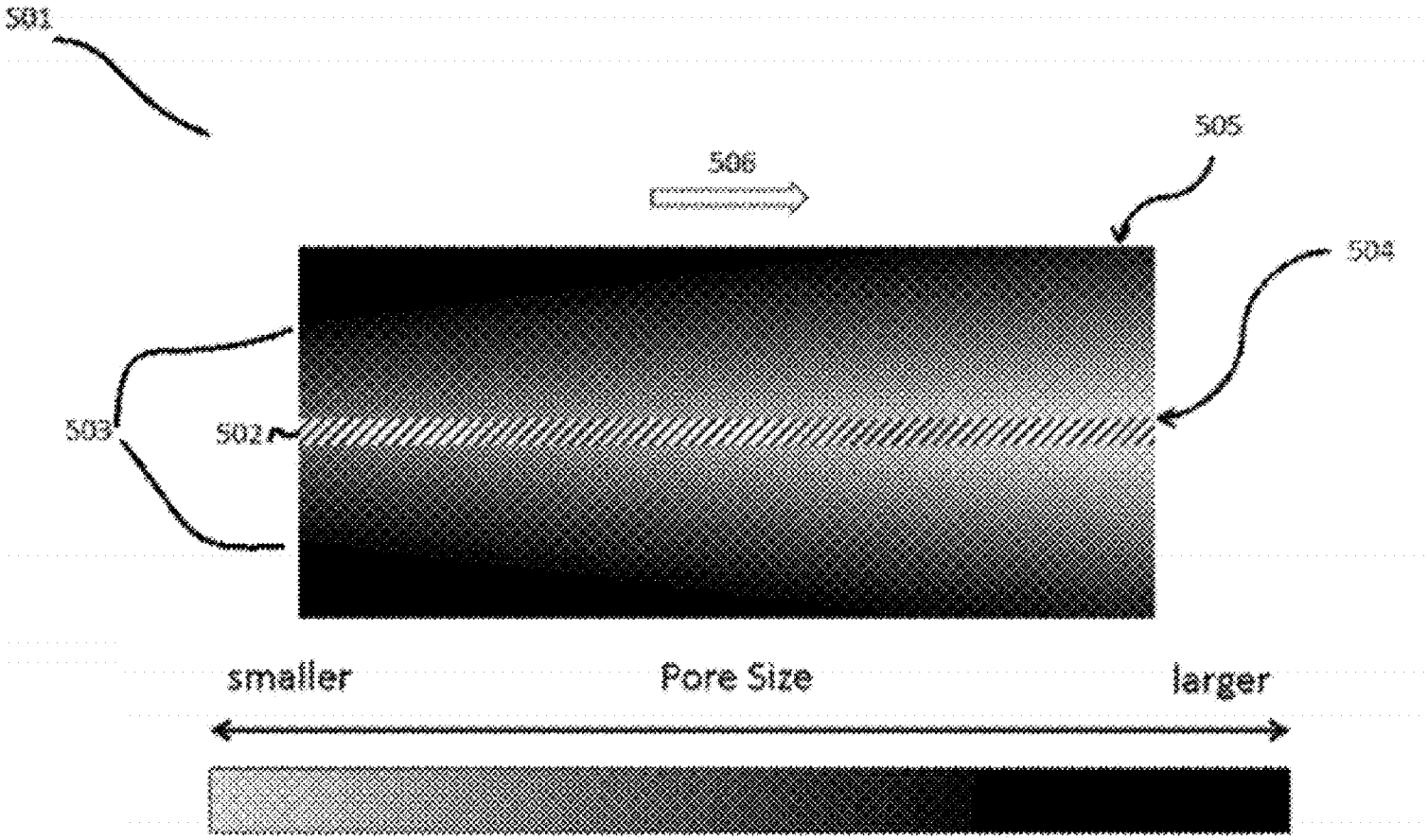
FIG. 2 is a cross section view of a nonhomogeneous, open-cell foam coating for EAC collector plates.

Referring to the FIG. 2 the foam coating on the first electrode (similar to the patent application 62/049,297, the disclosure of which is incorporated herein) is engineered such that the cell size on its outer surface is larger, as compared to the smaller cell size at its inner surface. Doing this can prevent small dust particles from settling on the outer surface of the foam and preventing bigger particles access to the inner volume of the foam. The smaller cell size foam will in turn help immobilize the smaller particles more effectively than the outer larger cell size foam. Such an arrangement can improve both the dust holding capacity of the foam covered first electrodes, as well as decrease re-entrainment of smaller dust particles into the airstream.

Furthermore, the outer surface cell size may also vary across the length of the collecting plate in the direction of the airflow. Since the mean size of the immobilized dust particles varies across the length of the first electrode (i.e. smaller particles will travel further inside the electrostatic precipitator, the foam cell size can be engineered to better accommodate the specific size of particles expected to be collected and immobilized at any point on the first electrode.

The outer surface may vary in only one of the directions (parallel or perpendicular to the airflow), and not the other of these respective directions. Moreover, the change in cell size may be in a gradient, continuously changing manner is indicated in the FIG. 2. In the FIG. 2 the proposed collector electrode 501 may include conductive plate 502 and open cell foam 503. Air flow direction is shown by the arrow 506. More dense color (505) shows foam cell with larger cell size while lighter color (504) shows smaller cell size.

Alternatively, the cell size may change based on a plurality of layers of foam, each having a different cell size, placed adjacent each other so as to collectively provide the change in cell size as discussed herein.

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology, as those skilled in the relevant art will recognize. For example, while steps are presented in a given order, alternative embodiments may perform steps in a different order. The various embodiments described herein may also be combined to provide further embodiments.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Where the context permits, singular or plural terms may also include the plural or singular term, respectively. It will also be appreciated that specific embodiments have been described herein for purposes of illustration, but that various modifications may be made without deviating from the technology. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

The invention is described in detail with respect to preferred embodiments, and it will now be apparent from the foregoing to those skilled in the art that changes and modifications may be made without departing from the invention in its broader aspects, and the invention, therefore, as defined in the claims, is intended to cover all such changes and modifications that fall within the true spirit of the invention.

Thus, specific apparatus for and methods of electrostatic precipitation and particle collection have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context.

We claim:

1. An electrostatic precipitator, comprising:

an electrode assembly, wherein the electrode assembly includes a plurality of first electrodes and a plurality of second electrodes, wherein the first electrodes include an internal first conductive portion and an outer surface generally parallel with an airflow through a cavity of the electrode assembly; wherein the first electrodes further include a first portion comprising a porous open cell material, wherein the porous material has a length generally parallel with the airflow and a thickness generally orthogonal to the air flow, said porous material comprising cells that vary in size through the length of the first electrode.

2. An electrostatic precipitator according to claim 1, wherein the porous material has greater cell size upwind and smaller cell size downwind of the airflow.

3. An electrostatic precipitator according to claim 1, wherein the porous material has greater cell size closer to an internal first conductive portion and smaller cell size outward of the internal first conductive portion.

4. An electrostatic precipitator according to claim 1, wherein the porous material has greater cell size downwind and smaller cell size upwind of the airflow.

5. An electrostatic precipitator according to claim 1, wherein the porous material has smaller cell size closer to an internal first conductive portion and a greater cell size outward of the internal first conductive portion.

6. A collector for use in an electrostatic precipitator comprising:

a planar conductive core;

a first porous material layer having an open cell structure mounted on a first side of said conductive core;

a second porous material layer having an open cell structure mounted on an opposing side of said conductive core;

wherein each of the first porous material layers and the second porous material layer have a first dominant cell size that is different in portions of the first and second porous material layers than a second dominant cell size in other portions of the first and second porous material layers.

7. The collector according to claim 6, wherein each of the first porous material layers and the second porous material layer have a greater dominant cell size closer to said conductive core and a smaller dominant cell size outward of said conductive core.

8. The collector according to claim 6, wherein each of the first porous material layer and the second porous material layer have a greater dominant cell size at one longitudinal end of the first and second porous material layers and a smaller dominant cell size distal from said longitudinal end of the first and second porous material layers.

9. The collector according to claim 8, wherein each of the first porous material layer and the second porous material layer have a greater dominant cell size closer to said conductive core and a smaller dominant cell size outward of said conductive core.

10. The collector according to claim 8, wherein each of the first porous material layers and the second porous material layer have a smaller dominant cell size closer to said conductive core and a greater dominant cell size outward of said conductive core.

11. The collector according to claim 10, wherein each of the first porous material layer and the second porous material layer have a greater dominant cell size at one longitudinal end of the first and second porous material layers and a smaller dominant cell size distal from said longitudinal end of the first and second porous material layers.

* * * * *